US008088442B2

(12) United States Patent
Boren

(10) Patent No.: US 8,088,442 B2
(45) Date of Patent: Jan. 3, 2012

(54) METHOD FOR PRESSURE IMPREGNATING WOOD OR WOOD PRODUCTS WITH WOOD PRESERVATIVE CONTAINING VEGETABLE OIL AND IMPREGNATED WOOD

(75) Inventor: Hannu Boren, Kohtavaara (FI)

(73) Assignee: Holjakka Oy, Joensuu (FI)

( * ) Notice: Subject to any disclaimer, the term of this patent is extended or adjusted under 35 U.S.C. 154(b) by 0 days.

(21) Appl. No.: 12/290,911

(22) Filed: Nov. 5, 2008

(65) Prior Publication Data

US 2009/0117400 A1 May 7, 2009

Related U.S. Application Data

(63) Continuation of application No. PCT/FI2007/000132, filed on May 16, 2007.

(30) Foreign Application Priority Data

May 22, 2006 (FI) ..... 20060497

(51) Int. Cl.
*B27K 3/00* (2006.01)

(52) U.S. Cl. ..... 427/317; 427/325; 427/351; 427/393; 428/536; 428/537.1

(58) Field of Classification Search ..... 428/536, 428/537.1; 219/779; 427/317, 325, 351, 427/393

See application file for complete search history.

(56) References Cited

U.S. PATENT DOCUMENTS

| | | | | |
|---|---|---|---|---|
| 3,785,770 | A | 1/1974 | Hudson | 21/7 |
| 4,258,240 | A * | 3/1981 | Pless | 219/773 |
| 4,942,067 | A | 7/1990 | Harding | 427/393 |
| 6,124,584 | A * | 9/2000 | Blaker et al. | 219/779 |
| 2002/0189491 | A1 | 12/2002 | Rettenbacher et al. | 106/15.05 |

FOREIGN PATENT DOCUMENTS

| | | | |
|---|---|---|---|
| FI | 104706 | B | 3/2000 |
| WO | WO-03/024680 | A1 | 3/2003 |
| WO | WO2004/022291 | * | 3/2004 |
| WO | WO-2004/022291 | A1 | 3/2004 |
| WO | WO2005/050110 | * | 6/2005 |
| WO | WO-2005/050110 | A1 | 6/2005 |

* cited by examiner

*Primary Examiner* — Leszek Kiliman
(74) *Attorney, Agent, or Firm* — Harrington & Smith

(57) ABSTRACT

The invention relates to a method for pressure impregnating wood or wood products with a wood preservative containing vegetable oils, in which method wood is pressure impregnated with a wood preservative containing vegetable oil. It is characteristic of the method according to the invention that, before starting the pressure stage, wood is heated so that at least part of its inner parts heat to a temperature of at least 50° C. and that, after the pressure impregnation, vacuum is formed in a space surrounding wood and simultaneously the surface layers of wood are heated to a temperature higher than the boiling point of water for removing wood preservative from the surface layers of wood. The invention also relates to wood or a wood product pressure impregnated in accordance with the method according to the invention.

19 Claims, 2 Drawing Sheets

METHOD FOR PRESSURE IMPREGNATING WOOD OR WOOD PRODUCTS WITH WOOD PRESERVATIVE CONTAINING VEGETABLE OIL AND IMPREGNATED WOOD

CROSS REFERENCE TO RELATED APPLICATION

This application is a continuation of International Patent Application No. PCT/FI2007/000132 filed on May 16, 2007.

FIELD OF THE INVENTION

The invention relates to a method for pressure impregnating wood or wood products, in which method wood is pressure impregnated with a wood preservative containing vegetable oil without drying agents or agents causing polymerization. The invention also relates to pressure impregnated wood or wood product.

BACKGROUND OF THE INVENTION

For preventing the decay of wood and for minimising the detrimental effects of micro organisms, it has been recently tried to find natural and environmentally-friendly wood preservatives, because many state of the art impregnants have been discovered to contain materials harmful to the nature and to human health. A material harmless to the environment and well applicable to the treatment of wood is crude tall oil, a by-product of the pulp industry, and products processed from it. Also the use of some other vegetable oils is possible, but crude tall oil has been discovered to be the most suitable for the use, inter alia, because it is widely available and its costs are relatively low. Furthermore, studies have recently shown that, because of resin and fatty acids it contains, wood can be effectively preserved by crude tall oil from the wood-decaying effects of rot fungi and other microbes when a sufficient amount of crude tall oil is obtained in the inner parts of wood. With Finnish pine, for instance, the preservation effect has been observed with over 100 kg residues per one cubic meter of wood. This amount corresponds about 20% of the dry weight of pine. The amount of crude tall oil must be about double compared with e.g. creosote oil in order to achieve a sufficient preservation effect against decay. Until 2005, the NTR-A class retention requirement for creosote oil was 135 kg per one cubic meter of impregnated sapwood. When using other vegetable oils, it is known that the amount has to be multiple compared with creosote oil in order to achieve a preservation effect of the same level against decay. It is possible to obtain such large amounts of oil within wood only by means of pressure impregnation.

As there must be large amounts of wood preservatives containing vegetable oils within wood, a problem has been that the wood preservative tends to bleed onto the surface of wood after pressure impregnation. This problem is especially caused by the infiltration of wood preservatives i.e. a considerably larger amount of wood preservative remains on the surface layers of wood than deeper in the wood. This phenomenon has been especially emphasised when impregnating green wood or wood having poor permeability for some other reason. The poorer the permeability of wood, the greater the infiltration is and the more easily the wood preservative bleeds onto the surface of wood. The infiltration can be very strong i.e. there can be a multiple amount of wood preservative on the surface layer of wood compared with the inner parts of wood. Bleeding occurs also during the use of wood, especially when the surface of wood heats e.g. by the effect of the heat of the sun. The wood preservative bleed onto the surface makes the outer surfaces of wood sticky. The sticky surface of wood is unpleasant as such and becomes dirty easily and its surface treatment e.g. by painting does not turn out well. In Finnish patent FI 114295 B, this problem was solved by drying wood to the moisture content of less than 10% before impregnating with a wood preservative containing vegetable oil and by heating the wood at the end of treatment to a temperature of over 150° C. for polymerising and drying the oils contained by the wood preservative. The amount of oil-bearing wood preservative in the wood treated in this way is however small (only about 30 liters per one cubic meter of treated wood), because in this method, the wood is impregnated without pressure. It is thus evident that, because of the small amount of wood preservative, there has been almost no bleeding problem in the case of wood treated by impregnation. In practice, it has been noticed that, e.g. in the case of pine, the bleeding of oil-bearing wood preservative increases considerably when the average content of wood preservative within wood increases over 100 kg per one cubic meter of impregnated wood. In the surface layer of pine containing this amount of wood preservative, there can be even over 200 kg/m$^3$ of wood preservative. It has been tried to solve the problem by the polymerisation/drying of wood preservative using high temperatures of over 130° C. and/or by adding catalysts and drying agents in the wood preservative. With these, it has been possible to decrease the bleeding because more solid wood preservative blocks up the cellular structure of the surface layers of wood so that the wood preservative expanding when heated cannot easily exit the wood. With the method, one has not been able to totally prevent the bleeding of the wood preservative and disadvantages caused by it. Furthermore, the use of the method impedes the actual impregnation process, because it hinders the penetration of wood preservative within the wood and, thus, the wood preservative is not evenly spread in the wood cells. It is also probable that the polymerisation weakens the ability of the preservative to prevent moulding and decay, because then the biocide components of oil are not able to affect the organisms contributing to moulding and decay. In addition, e.g. in the case of wood poles impregnated in this way, dryer agents and the polymerisation of oil prevent the natural run-off of the oil-bearing wood preservative at the base of the pole and on ground level where the risk of decay is the greatest.

The object of the invention is to provide a method by means of which above-mentioned problems related to known methods are eliminated. The object of the invention is especially to introduce a method by means of which pressure impregnated wood can be manufactured with a wood preservative containing vegetable oil so that the preservative does not bleed onto the surface of wood after impregnation, even though no agents causing polymerisation or drying agents were added to the preservative and even though large amounts of wood preservative containing vegetable oil were impregnated within the wood. Furthermore, the object of the invention is to introduce a method by means of which also green wood (moisture content of wood over 28%) and poorly impregnatable wood, e.g. pine heartwood and spruce, can be pressure impregnated with vegetable oil based wood preservatives so that the wood preservative does not bleed onto the surface of wood after pressure impregnation. The object of the invention is further to introduce wood pressure impregnated with a wood preservative containing vegetable oil the wood preservative of which does not bleed onto the surface of wood during the use of wood, even though a large amount of the wood preservative containing vegetable oil has been impregnated in the wood.

DESCRIPTION OF THE INVENTION

In the method according to the invention wood is pressure impregnated with a wood preservative containing vegetable oil without drying agents or agents causing polymerization and before starting the pressure stage, wood is heated so that at least part of its inner parts heat to a temperature of at least 50° C. and after the pressure impregnation, vacuum is formed in the surrounding space of wood and simultaneously the surface layers of wood are heated to a temperature higher than the boiling point of water at least 75 minutes for removing wood preservative from the surface layers of wood. With such a method, an expansion space is formed on the surface layer of pressure impregnated wood so that the wood preservative within the wood can expand without starting to bleed onto the surface of wood. Thus this way, a surface remaining dry is obtained in wood impregnated with a wood preservative containing vegetable oil without polymerisation or the use of dryers. With the method, the average amount of wood preservative contained in the wood can be even 300 kg/m$^3$ and still the surface of wood remains dry and non-staining. There are many different methods for adjusting the amount of oil on the surface layer of wood. By heating the wood to a temperature of at least 50° C. and for most wood species to a temperature higher than the boiling point of water before starting the pressure stage in accordance with the method according to the invention, it is possible to make water within the wood vaporise strongly, because of which the pressure of wood cells increases quickly causing tears on the wood cell walls. If vacuum is then formed in the surrounding space after the heating, the tearing of the cell walls is further intensified. The tearing of cell walls provided with the method increases the permeability of wood and thus its impregnation capacity especially with moisture and/or poorly impregnatable wood, such as e.g. the heartwood of pine. Furthermore, when after the pressure impregnation vacuum is formed in the space surrounding the wood and the temperature is raised on the surface layer of wood most preferably to the level of the temperature of oil in the pressure impregnation (still usually at least over the boiling point of water in the prevailing pressure), it is possible to make wood preservative to exit from the surface layers of wood e.g. by underpressurised or saturated vapour. This way, the above-mentioned expansion space is formed on the surface layer of wood. For removing the wood preservative from the surface layers of wood, also superheated vapour can be used. Then the water exiting from the wood raises the wood preservative onto the surface of wood from which it is easy to remove the wood preservative with underpressurised or saturated vapour. This method is especially suitable for wood impregnated when moisture, because simultaneously moisture content can be removed from the wood.

In an embodiment of the method according to the invention, wood is impregnated with crude tall oil, resin and/or fatty acids separated from it or a mixture of these. Such wood preservatives containing vegetable oil are cost-effective and their availability is good because crude tall oil is produced as a by-product of the pulp industry.

In an embodiment of the method according to the invention, wood is heated by means of vapour during the vacuum stage after the pressure impregnation. This way, it is possible to decrease the amount of wood preservative remaining on the surface layer of wood after the pressure stage and to wash the surface of wood clean and non-staining before the later use of wood.

In an embodiment of the method according to the invention, after the pressure stage, the content of wood preservative on the surface layer of wood is adjusted to less than 75% of the dry weight of wood. Such an amount of vegetable oil based wood preservative will not bleed onto the surface of wood but effectively preserves the surface layers of wood from weather and decay.

In an embodiment of the method according to the invention, wood is impregnated in an impregnating chamber, which is heated to a temperature of over 50° C. before conveying the wood preservative into the impregnating chamber. Also raising the heat in this way facilitates the penetration of the preservative within the wood, because as the temperature raises the viscosity of the vegetable oil based preservative decreases.

In an embodiment of the method according to the invention, into the impregnating chamber is blown before starting the pressure stage compressed air heated to a temperature of over 50° C. so that the pressure of the impregnating chamber increases above normal pressure. This way, it is possible to heat the air in the impregnating chamber extremely quickly and to raise the pressure of air surrounding the wood so that the hot air tries to enter the wood, whereby it heats the wood also from its inner parts.

In an embodiment of the method according to the invention, hot vapour and/or hot air is circulated in the impregnating chamber before the pressure stage and/or after it. This way, it is possible to heat the wood pieces being treated as evenly and quickly as possible all around. This decreases the time spent in heating wood in the heating stage of wood, facilitates the penetration of the wood preservative within the wood in the pressure stage and the exit from the surface layers of wood in the vacuum stage after the pressure stage, and thus decreases the bleeding of the wood preservative onto the surface of wood after the pressure impregnation treatment.

In an embodiment of the method according to the invention, the wood being impregnated and the wood preservative are heated before transferring them into the impregnating chamber. This way, it is possible to decrease the viscosity of the wood preservative, whereby the penetration of the wood preservative within the wood is facilitated and quickened. Furthermore, the pre-heated wood preservative heats the wood when penetrating within the wood during the pressure stage. In addition, by means of the heated wood preservative, it is possible to raise the temperature of wood extremely quickly.

In an embodiment of the method according to the invention, the impregnating chamber is heated during the vacuum stage by heating devices within the impregnating chamber. Lowering the pressure of the impregnating chamber during the vacuum stage also lowers the temperature of the impregnating chamber. This increases the viscosity of the wood preservative within the wood and thus impedes the exit of the wood preservative from the surface layers of wood. By heating the impregnating chamber during the vacuum stage with a suitable heating device, which can be e.g. a hot-water radiator etc., it is possible to minimise cooling and promote the exit of the wood preservative from the surface layers of wood.

In an embodiment of the method according to the invention, after the vacuum stage or during it, hot saturated vapour is conveyed in the impregnating chamber for removing the wood preservative from the surface layers of wood. After the vacuum stage, on the surface of wood there is wood preservative, which has come out of the surface layers of wood. By conveying hot saturated vapour in the impregnating chamber, it is possible to clean the wood preservative on the surface of wood and on the surface layers of wood. Because of this, it is possible to make the surface of wood non-staining and to further minimise the amount of wood preservative on the surface layers of wood so that no bleeding of wood preservative takes place during the use of wood.

Wood or wood product according to the invention is pressure impregnated with a wood preservative containing vegetable oil without drying agents or agents causing polymerization. The wood is heated before starting the pressure stage so, that at least part of its inner parts are heated to a temperature of at least 50° C. and that, after the pressure impregnation, vacuum is formed in the space surrounding wood and simultaneously the surface layers of wood are heated to a temperature higher than the boiling point of water and this environment is maintained surrounding wood at least 75 minutes for removing the wood preservative from the surface layers of wood. Such impregnated wood is a safe material for the environment and human health applicable to the same uses as wood impregnated with known methods and wood preservatives. Furthermore, no oily wood preservative bleeds onto the surface of wood from such wood impregnated with a wood preservative containing vegetable oil, which makes the surface of wood sticky and awkward to be treated later.

DESCRIPTION OF DRAWINGS

The invention will now be described with reference to the figures of the accompanying drawings in which.

Figure 1:
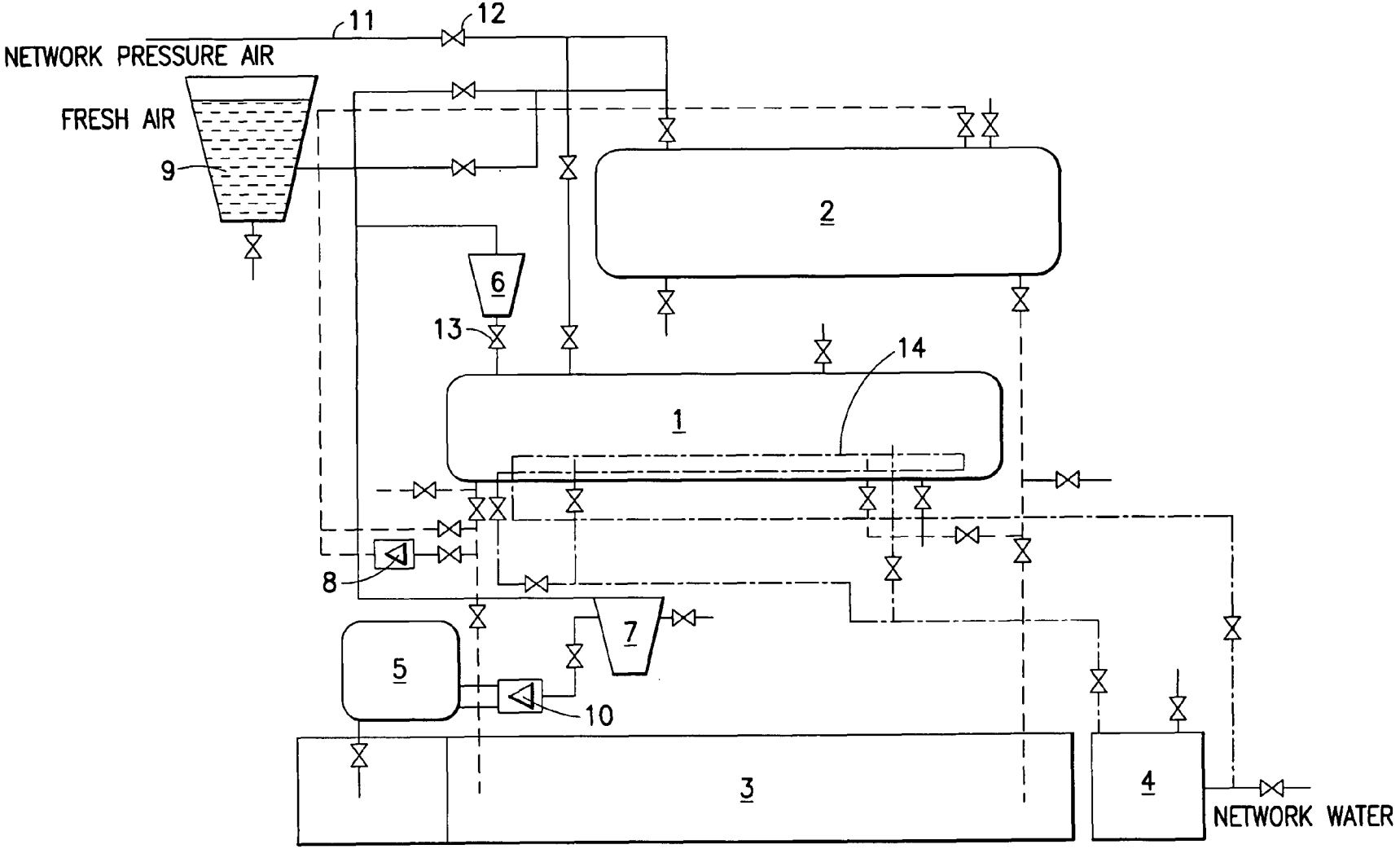
FIG. 1 shows a diagram of the principle of an impregnation apparatus used in an embodiment of the method according to the invention.

The method according to the invention can be implemented e.g. by means of an apparatus according to FIG. 1. This apparatus contains an impregnating cylinder 1, a heating cylinder 2 and a preservation/treating solution tank 3 and, inter alia, required transfer channels and a transfer pump 8 in order to be able to pump wood preservative along the transfer channels from the treating solution tank 3 to the heating cylinder 2, from the heating cylinder 2 to the impregnating cylinder 1, and from there back to the preservation/treating solution tank 3. Furthermore, the apparatus contains, inter alia, an outlet tank 9, a vacuum pump 10 with its vacuum and cooling water tanks 5, 6 and 7 and a feed system 11 of compressed air, a feed valve 12 of compressed air, a relief valve 13 of compressed air, by means of which the pressure in the impregnating cylinder can be adjusted during impregnation. In addition, the apparatus contains vaporisation devices 4 coupled with vapour feed channels in the impregnating cylinder 1 by means of which within the impregnating cylinder can be conveyed water vapour or to circulate vapour in a heating coil 14 located at the bottom of the impregnating cylinder and a necessary number of parts shown in FIG. 1, known as such, required in the transfer channels of wood preservative, compressed air and vapour which parts are essential for enabling the operation of the apparatus, inter alia, in a way described later.

The method according to the invention, in which the apparatus in accordance with the diagram of the principle shown in FIG. 1 is used, was tested by pressure impregnating test pieces of pine (*Pinus sylvestris*) the moisture content and external dimensions of which are described in Table 1.

TABLE 1

Initial data of test material in Test 1.

| Test piece no. | Dimension, mm | Volume, $m^3$ | Initial moisture content, % |
|---|---|---|---|
| 1 | block 105 × 130 × 4040 | 0.045 | 16 |
| 2 | block 105 × 130 × 4030 | 0.045 | 16 |
| 3 | block 105 × 130 × 4035 | 0.046 | 16 |
| 4 | circular 115 × 135 × 4020 | 0.049 | 16 |
| 5 | circular 125 × 135 × 4035 | 0.055 | 16 |

Figure 2:
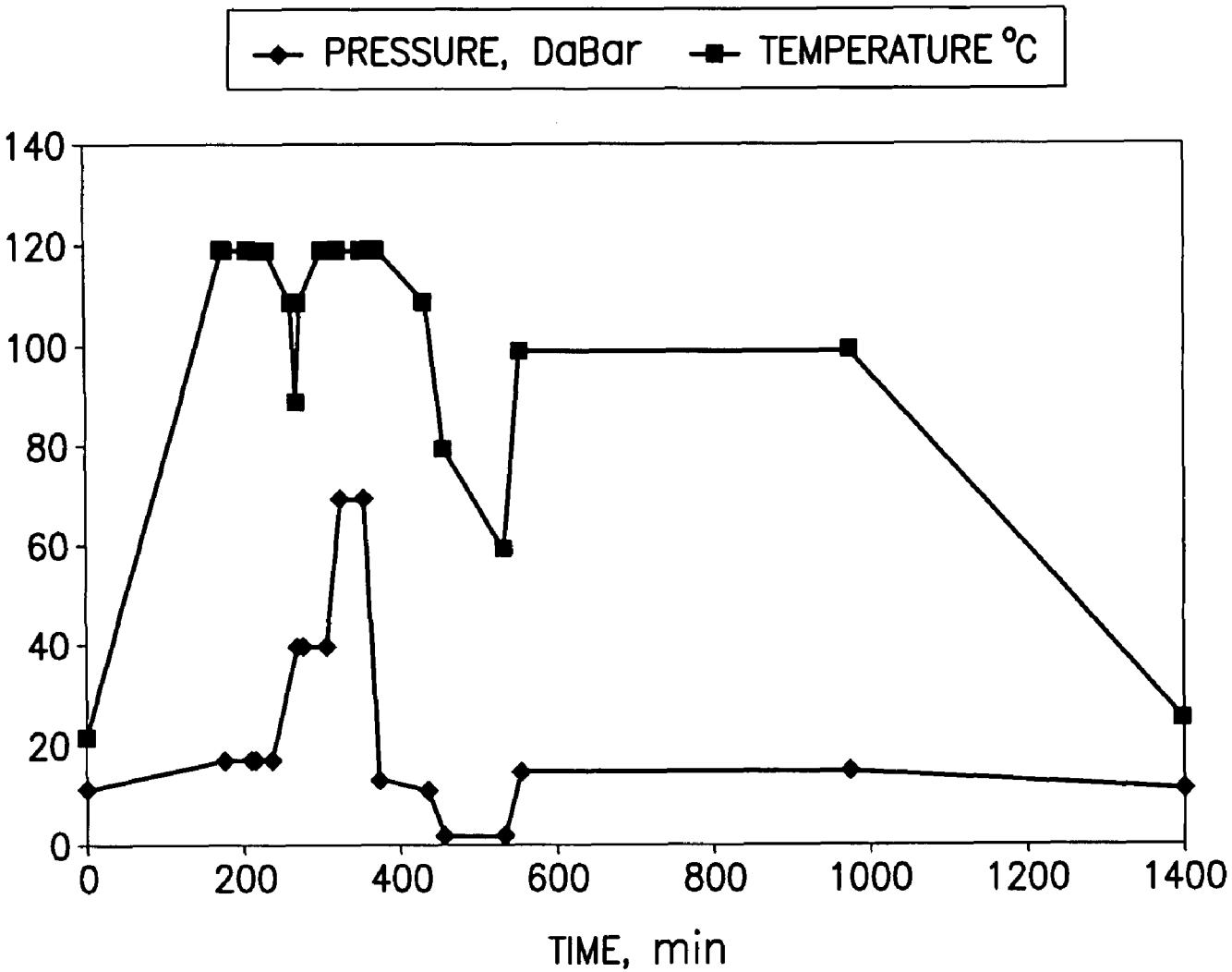
FIG. 2 shows a diagram of temperature and time in a pressure impregnation test implemented in accordance with the method according to the invention in which the impregnation apparatus according to FIG. 1 is used.

Before transferring and closing the test pieces in the impregnating cylinder 1 of the apparatus according to FIG. 1, they were dried in a way known as such so that the moisture content measured on the surface of wood was only about 16% according to Table 1. After this, the test pieces were transferred in the impregnating cylinder 1 of the apparatus for pressure impregnation. The temperature and the pressure of the impregnating cylinder in the different stages of the pressure impregnation process are seen in the diagram of FIG. 2. At the beginning of the treatment, the wood pieces being treated were heated with vapour to the temperature of 120° C. and kept in this temperature for about an hour in order to have also the inner parts of wood heat sufficiently. The purpose of the initial heating is that, by means of it, the cooling of crude tall oil and the decrease of the viscosity of oil caused by it are avoided. Furthermore, it is possible to increase the back flow of oil from the surface layers of wood at the end stage of the process from the effect of heat produced this way. Next, the air pressure of the impregnating cylinder was increased to 4 bar by conveying compressed air in the impregnating cylinder from an internal supply of compressed air at the test facility. This pressure was maintained in the impregnating cylinder for about 10 minutes in order to increase also the pressure within the wood pieces to the desired 4 bar. The temperature of supplied compressed air conveyed in the impregnating cylinder was about 20° C., whereby the temperature of the impregnating cylinder was lowered from the effect of the blowing of compressed air from the temperature of about 110° C. to the temperature of about 90° C. Thus, it would be advantageous to heat the used compressed air up to the level of the temperature of wood. Then, the result of the treatment would be even better, because the temperature of the cylinder and wood were not lowered in the pressure increase stage. After this, the impregnating cylinder 1 was filled with crude tall oil heated to the temperature of about 120° C. in the heating cylinder 2 so that the pressure of the impregnating cylinder was not able to decrease during the filling stage. The extra compressed air was relieved through the relief valve 13 in the cylinder during the filling stage. Next, the pressure of the impregnating cylinder was increased by means of the supplied compressed air to about 7 bar for 30 minutes during which time the temperature of the impregnating cylinder raised to 120° C. The crude tall oil was circulated between the impregnating cylinder and the heating cylinder during the pressure stage by means of the transfer pump 8. Because of this, the temperature of oil was hardly able to lower during this stage. Next, the crude tall oil was transferred from the impregnating cylinder in the heating cylinder 2, after which as strong as possible vacuum (vacuum) was pumped in the impregnating cylinder with the vacuum pump 10 and by means of the vacuum tanks 6 and 7. From the effect of the high temperature of wood, the air pressure in the wood (formed during the initial air pressure) and the strong vacuum, it was possible to remove a lot of oil from the surface layer of wood. In the vacuum treatment, oil is usually removed from within the wood only mainly from the depth of about 0-10 mm from the surface of wood. Thus, after the vacuum treatment, a sufficient expansion space remains within the wood for the oil in the inner parts, because of which the bleeding of crude tall oil after the impregnation cannot take place. During the vacuum treatment, the temperature of the impregnating cylinder was lowered to the temperature of 60° C. In order for the lowering of temperature be as small as possible, there should be a radiator (or some other suitable heating device) in the impregnating cylinder by means of which it would be possible to maintain a sufficiently high temperature during the vacuum stage. The vacuum stage was maintained for 75 minutes, after which water vapour in the temperature of 100° C. produced by the vaporisation devices was fed in the impregnating cylinder for about 7 hours. Finally, wood was washed with the vapour for another 7 hours during which time the temperature was let to lower freely to room temperature. This way, the amount of oil on the surface layer of wood was further decreased. The temperature of vapour should be at the beginning at least the same as the end temperature of oil. In the final stage of vaporisation, saturated vapour should be used by means of which the desired "wash effect" is best achieved.

After the pressure impregnation done in accordance with the method according to the invention, the dryness of the surface of test pieces was examined and the amount of crude tall oil remaining in the test pieces was determined by means of weighing before and after the pressure impregnation. The impregnation of the test pieces took place in the spring, at the turn of April and May. After the test, the test pieces were brought outside, on a sunny site where their surfaces were observed at the intervals of about two weeks for about three months. As a result of the test, it was discovered that after the pressure impregnation the average of about 173 kg/m$^3$ of wood preservative remained within the wood and that after the impregnation no crude tall oil bleeded onto the surfaces of the wood pieces. Furthermore, in all examinations of the surface during the monitoring period of three months, the surfaces were verified to have remained totally dry and non-staining.

The method according to the invention can be implemented in many aspects different from the embodiment described here as an example. The method is exceptionally well suitable for pressure impregnating wood pieces of different dimensions with a wood preservative containing vegetable oil. Naturally with the method, it also is possible to impregnate non-finished wood products. Substantial in the method is to obtain the vegetable oil bearing wood preservative within the wood so that a sufficient expansion space remains on the surface layers of the wood so that the preservative will not start to bleed onto the surface of the wood straight after the washing stage nor later during the use of the wood. Providing a required expansion space within the wood can be furthered e.g. by the following ways:

1. Drying wood before the pressure impregnation to sufficient dryness (e.g. so that the moisture content of wood is less than 28%), whereby it is easier for the wood preservative containing mainly vegetable oil to penetrate evenly also deeper in the wood. If the wood is moisture, water in the wood prevents the penetration of oil especially deeper in the wood. If the aim is to obtain within the wood e.g. a hundred kilos of wood preservative per cubic meter, when impregnating green wood, a larger part of the wood preservative remains on the surface layer of the wood than when impregnating dry wood. However, the effect of moisture content can be eliminated with suitable process changes.
2. Heating the pieces of wood to be treated and the wood preservative as hot as possible before impregnating. The heating of the pieces of wood can take place e.g. by means of the hot wood preservative by conveying the hot wood preservative in the impregnation space before starting the actual pressure stage and by circulating the impregnant used in heating after this to be re-heated before the actual pressure stage. The heating of the pieces of wood and the wood preservative makes the wood preservative flexible and improves the permeability of wood, especially if the temperature of wood is raised above the boiling point of water. When simultaneously vacuum is formed in the impregnation space, a situation is provided in which vaporising water causes tears in the vicinity of the bordered pits of cell walls. This improves the permeability of wood, whereby the even penetration of the preservative within the wood is possible.
3. If the Ruping process is utilised, the compressed air being used is heated hot.
4. Aiming at raising the temperature of the impregnation process as it proceeds. Especially during the vacuum stage, the impregnating cylinder should be heated e.g. by radiators in order for the wood preservative used not to solidify within the wood but be flexible and exit from the effect of strong vacuum.
5. Using underpressurised and/or saturated and/or compressed vapour after the vacuum stage, whereby it is possible to remove and wash all the possibly bleeding wood preservative from the surface of the wood. Instead of vapour, the pieces of wood can be heated by some other method, whereby the wood preservative on the surface layer expands and bleeds out. It is still best to wash this bleeding wood preservative away with saturated vapour.
6. Circulating hot vapour or air in the impregnating chamber after the pressure stage before forming vacuum in the impregnating chamber and/or during it. This takes place e.g. by installing a frequency transformer in the vacuum pump, whereby it is possible by means of the pump to achieve a small suction at one end of the impregnating chamber simultaneously as when feeding from the other end suitably vapour, hot compressed air or only hot air in the impregnating chamber via a valve. Then, the vapour or hot air flows effectively through the pieces of wood.

Many times providing the expansion space is complicated by the weak permeability of wood. A reason for this can be the high moisture content of wood, heartwood, blue discoloration or otherwise naturally poorly impregnatable wood, such as e.g. spruce (*Picea abies*). As mentioned above, the weak permeability of wood can be improved by vaporising water in the wood, whereby the pressure in the wood cells increases so that tears are formed in the vicinity of the bordered pits of cell walls. This facilitates the movement of liquids within the wood so that the wood preservative containing vegetable oil is able to easily penetrate the inner parts of wood.

If an impregnated wood product bleeds or is staining after the impregnation e.g. because of the high moisture content of wood, the extra wood preservative can be removed from the surface layer of wood by re-vaporising or repeating the whole process otherwise in the same way as before but shortening the pressure stage to only a few minutes or without increasing the oil pressure. The aim is that the surface of wood is dry and non-staining. It is possible to choose those of the above-described treatment methods, which are best, suited for the wood species in question and the type of vegetable oil in the wood preservative. It should be also noted that in the impregnation can be used some other wood preservative than one containing crude tall oil or a suitable wood preservative can be processed from crude tall oil by inserting suitable additives in the crude tall oil which can be e.g. other vegetable oils suitable for preserving wood or other additives safe for the nature and human health.

The invention claimed is:

1. A method for pressure impregnating wood or wood products, in which with a wood preservative containing vegetable oils, in which method wood is pressure impregnated with a wood preservative containing vegetable oil without drying agents or agents causing polymerization, before starting a pressure stage, wood is heated so that at least part of its inner parts heat to a temperature of at least 50° C., and after a pressure impregnation, vacuum is formed in a space surrounding wood and simultaneously the surface layers of wood are heated to a temperature higher than the boiling point of water at least 75 minutes for removing the wood preservative from the surface layers of wood.

2. A method according to claim 1, in which wood is impregnated with crude tall oil, resin and/or fatty acids separated from it or a mixture of these.

3. A method according to claim 1, in which wood is heated by means of vapour during the vacuum stage after the pressure impregnation.

4. A method according to claim 1, in which after the pressure stage, the content of wood preservative on the surface layer of the wood is adjusted to less than 75% of the dry weight of wood.

5. A method according to claim 1, in which wood is impregnated in an impregnating chamber, which is heated to a temperature of over 50° C. before conveying the wood preservative in the impregnating chamber.

6. A method according to claim 5, in which into the impregnating chamber is blown before starting the pressure stage compressed air heated to a temperature of over 50° C. so that the pressure of the impregnating chamber increases above normal pressure.

7. A method according to claim 5, in which hot vapour and/or hot air is circulated in the impregnating chamber before the pressure stage and/or after it.

8. A method according to claim 5, in which the wood being impregnated and the wood preservative are heated before transferring them in the impregnating chamber.

9. A method according to claim 5, in which after the pressure stage in the impregnating chamber is conveyed hot saturated vapour for removing the wood preservative from the surface layers of wood.

10. A method comprising:

heating wood so that an inner part of the wood is heated to a temperature of at least 50° C.;

after the wood is heated, pressure impregnating the heated wood with a wood preservative containing vegetable oil without drying agents or agents causing polymerization; and after the wood is pressure impregnated with the wood preservative, forming a vacuum in a space surrounding the wood and simultaneously heating surface layers of the wood to a temperature higher than a boiling point of water for at least 75 minutes and removing the wood preservative from the surface layers of the wood.

11. A method according to claim 10, in which the step of pressure impregnating the wood comprises impregnating the wood with crude tall oil, resin and/or fatty acids separated from the crude tall oil, or a mixture of these.

12. A method according to claim 10, in which the wood is heated by vapour during the vacuum.

13. A method according to claim 10, in which after the wood is pressure impregnated, content of the wood preservative on the surface layers of the wood is adjusted to less than 75% of a dry weight of the wood.

14. A method according to claim 10, in which the step of pressure impregnating the heated wood comprises use of an impregnating chamber, wherein the impregnating chamber is heated to a temperature of over 50° C. before conveying the wood preservative in the impregnating chamber.

15. A method according to claim 14 wherein, before starting the pressure impregnating of the heated wood, compressed air heated to a temperature of over 50° C. is blown into the impregnating chamber so that the pressure of the impregnating chamber increases above a normal pressure.

16. A method according to claim 14, in which hot vapour and/or hot air is circulated in the impregnating chamber before the pressure impregnating of the heated wood and/or after the pressure impregnating of the heated wood.

17. A method according to claim 14, in which the heated wood being impregnated and the wood preservative are heated before transferring them into the impregnating chamber.

18. A method according to claim 14, in which after the pressure impregnating of the heated wood in the impregnating chamber, hot saturated vapour is conveyed for removing the wood preservative from the surface layers of wood.

19. A method comprising:

heating wood so that an inner part of the wood is heated to a temperature of at least 50° C.;

after the wood is heated, pressure impregnating the heated wood with a wood preservative containing vegetable oil without drying agents or agents causing polymerization, wherein the wood preservative comprises crude tall oil, resin and/or fatty acids separated from the crude tall oil, or a mixture of these; and after the wood is pressure impregnated with the wood preservative, forming a vacuum in a space surrounding the wood and simultaneously heating surface layers of the wood to a temperature higher than a boiling point of water for at least 75 minutes and removing the wood preservative from the surface layers of the wood, wherein the wood is heated by vapour during the vacuum, and wherein content of the wood preservative on the surface layers of the wood is adjusted to less than 75% of a dry weight of the wood.

* * * * *